US010178898B2

(12) United States Patent
Koizumi et al.

(10) Patent No.: US 10,178,898 B2
(45) Date of Patent: Jan. 15, 2019

(54) METALLIC FASTENER MEMBER AND FASTENER EQUIPPED WITH SAME

(71) Applicant: YKK Corporation, Tokyo (JP)

(72) Inventors: Takuya Koizumi, Toyama (JP); Kouta Kido, Toyama (JP); Yasuhara Yoshimura, Toyama (JP); Kyudo Ota, Toyama (JP); Itaru Hasegawa, Toyama (JP); Kazuya Akitsu, Toyama (JP); Yuri Katsumi, Toyama (JP)

(73) Assignee: YKK Corporation (JP)

( * ) Notice: Subject to any disclaimer, the term of this patent is extended or adjusted under 35 U.S.C. 154(b) by 8 days.

(21) Appl. No.: 15/552,455

(22) PCT Filed: Mar. 12, 2015

(86) PCT No.: PCT/JP2015/057376
§ 371 (c)(1),
(2) Date: Aug. 21, 2017

(87) PCT Pub. No.: WO2016/143138
PCT Pub. Date: Sep. 15, 2016

(65) Prior Publication Data

US 2018/0049521 A1 Feb. 22, 2018

(51) Int. Cl.
*A44B 19/24* (2006.01)
*A44B 19/02* (2006.01)
(Continued)

(52) U.S. Cl.
CPC ..... *A44B 19/24* (2013.01); *A44B 19/02* (2013.01); *C22C 9/04* (2013.01); *C23F 11/00* (2013.01); *C23F 11/149* (2013.01); *Y10T 24/25* (2015.01)

(58) Field of Classification Search
CPC ..... A44B 19/24; A44B 19/02; C22C 9/04; C23F 11/00; C23F 11/149; Y10T 24/25
See application file for complete search history.

(56) References Cited

U.S. PATENT DOCUMENTS 6,866,728 B2 * 3/2005 Kawazoe ..... C22C 21/06 148/440
2013/0104349 A1 * 5/2013 Yoshimura ..... C22C 9/04 24/415
2015/0218674 A1 8/2015 Kido et al.

FOREIGN PATENT DOCUMENTS

EP 2883971 A1 6/2015
JP H08-24012 A 1/1996
(Continued)

OTHER PUBLICATIONS

International Search Report, PCT Patent Application No. PCT/JP2015/057376, dated Jun. 9, 2015.
(Continued)

*Primary Examiner* — Robert Sandy
*Assistant Examiner* — Michael S Lee
(74) *Attorney, Agent, or Firm* — Kilpatrick Townsend & Stockton LLP

(57) ABSTRACT

An improved season cracking resistance of a metallic fastener member is provided and includes a copper alloy containing zinc as a base material. The metallic fastener member includes, as a base material, a copper alloy containing zinc, and the metallic fastener member has a surface to which a rust prevention treatment has been applied and has such a property that, when analyzed by a scanning X-ray photoelectron spectroscopy apparatus, a maximum value of an atomic concentration of Mn is detected at a depth of 100 nm or less from the surface.

15 Claims, 9 Drawing Sheets

(51) Int. Cl.

| | |
|---|---|
| ***C22C 9/02*** | (2006.01) |
| ***C22C 9/04*** | (2006.01) |
| ***C23F 11/00*** | (2006.01) |
| *C23F 11/14* | (2006.01) |

(56) References Cited

FOREIGN PATENT DOCUMENTS

| | | | |
|---|---|---|---|
| JP | 2003-113454 | A | 4/2003 |
| JP | 2004-332014 | A | 11/2004 |
| WO | 2014/004841 | A1 | 1/2014 |
| WO | 2014/024293 | A1 | 2/2014 |

OTHER PUBLICATIONS

International Preliminary Report on Patentability, PCT Patent Application No. PCT/JP2015/057376, dated Sep. 21, 2017.

* cited by examiner

METALLIC FASTENER MEMBER AND FASTENER EQUIPPED WITH SAME

This application is a national stage application of PCT/JP2015/057376, which is incorporated herein by reference.

TECHNICAL FIELD

The present invention relates to a metallic fastener member comprising a copper alloy as a base material. The present invention also relates to a fastener comprising the metallic fastener member comprising the copper alloy as the base material.

BACKGROUND ART

Some of fastener products include copper alloy fasteners in which a copper alloy containing zinc, such as brass, red brass and nickel silver (hereinafter also referred to as a "Cu—Zn based alloy") is used for parts (for example, an element row as an engaging portion, a slider for controlling engagement and disengagement of the element row and opening and closing a fastener, and the like). Zinc is an alloy element that is conventionally added to the copper alloy fastener because zinc has an effect of increasing strength, hardness and uniform deformation of the alloy by a solid solute effect, and zinc is inexpensive as compared with copper and has thus good economical efficiency.

However, the zinc element present in copper may cause a problem of remarkably deteriorating corrosion resistance. The fastener parts produced by using a copper alloy with higher zinc content and particularly via cold working such as press molding have caused a problem of season cracking due to residual working strain. If the Zn content in the copper alloy is more than 10% by mass, the season cracking resistance will be rapidly deteriorated.

To improve the season cracking resistance of the Cu—Zn based alloy, it is considered that the proportion of zinc in the alloy is decreased to less than 10%. However, such an alloy with decreased zinc content is not desirable as a copper alloy for fasteners, because the alloy will not only increase material costs but also have insufficient strength. Therefore, Japanese Patent Application Public Disclosure (KOKAI) No. 2004-332014 A (Patent Document 1) proposes a process for producing a Cu—Zn alloy having improved season cracking resistance, characterized by subjecting a Cu—Zn based alloy containing at least Zn of more than 10%, which has been cold-worked, to a treatment for reducing tensile residual stress or for bringing about a state of compressive residual stress on the alloy surface. As specific methods of the above treatment, this document lists surface hardening methods such as shot peening, shot blasting, sandblasting and steel ball shot blasting.

Further, there are also following documents which disclose that a crystal structure of the Cu—Zn based alloy is formed as a mixed phase of an α phase having a face-centered cubic structure and a β phase having a body-centered cubic structure, and the ratio of the phases is controlled, thereby improving the season cracking resistance.

For the purpose of providing a copper-zinc alloy product having improved season cracking resistance and stress corrosion cracking resistance as well as cold workability and appropriate strength, WO 2014/004841 (Patent Document 2) discloses a copper-zinc alloy product composed of a copper-zinc alloy containing zinc of more than 35 wt % and 43 wt % or less and having a two-phase structure of an α phase and a β phase, wherein a ratio of the β phase in the copper-zinc alloy is controlled to be greater than 10% and less than 40%, and crystal grains of the α phase and the β phase are crushed into a flat shape by cold working so that the crystal grains are arranged in the form of a layer. This document also discloses that the flat β phase crystal grain is preferably layered in a crossing direction to a direction in which season cracking due to residual stress or cracking due to stress corrosion cracking is developed.

For the purpose of providing a copper alloy for fastening which has improved manufacturability, season cracking resistance and cold workability, WO 2014/024293 (Patent Document 3) discloses a copper alloy for fastening whose structure is comprised of a mixed phase of an α phase and a β phase, and wherein the copper alloy has a composition represented by a general formula: $Cu_{bal.}Zn_aMn_b$ in which the symbols bal., a and b are expressed in % by mass, bal. denotes the balance, $34 \leq a \leq 40.5$ and $0.1 \leq b \leq 6$, and unavoidable impurities may be contained; and satisfying the following equations (1) and (2):

$$b \geq (-8a+300)/7 \text{ in which } 34 \leq a \leq 37.5 \quad (1)$$

$$b \leq (-5.5a+225.25)/5 \text{ in which } 35.5 \leq a \leq 40.5 \quad (2).$$

This document also discloses that in order to improve the season cracking resistance, the ratio (%) of the β phase in the crystal structure is preferably $0.1 \leq \beta \leq 22$.

On the other hand, the copper alloy fastener members have been subjected to an element surface treatment with a rust prevention agent represented by benzotriazole-based compounds, in terms of prevention of discoloration. For example, Japanese Patent Application Public Disclosure (KOKAI) No. H08-24012 A (Patent Document 4) discloses a method for producing a slide fastener chain via polishing and rust prevention treatments, comprising a series of steps of degreasing and neutralizing a slider fastener chain having copper or copper-based alloy elements attached thereon, and then subjecting the slide fastener chain to a chemical polishing treatment by dipping the slide fastener chain in a chemical polishing solution, pickling it, and further subjecting it to a rust prevention treatment by immersing it in a rust prevention solution, and then washing the slide fastener chain with water, drying it and coating it with clear coating and drying it.

PRIOR ART DOCUMENT

Patent Document

[Patent Document 1] Japanese Patent Application Public Disclosure (KOKAI) No. 2004-332014 A
[Patent Document 2] WO 2014/004841
[Patent Document 3] WO 2014/024293
[Patent Document 4] Japanese Patent Application Public Disclosure (KOKAI) No. H08-24012 A

SUMMARY OF THE INVENTION

Problem to be Solved by Invention

The copper alloy described in Patent Document 1 requires the surface treatment such as shot blasting and thus increases the number of manufacturing steps, which may cause the manufacturing costs to be increased. Patent Documents 2 and 3 are based on the formation of the mixed phase of α phase and β phase. However, when the β phase is present, cold workability will become unavoidably lower than the case where a single phase of α phase is present. Further, when forming the mixed phase of α phase and β phase, strict control of the composition range and the heat treatment conditions are required for achieving a desired β phase ratio, which will cause constraints on the production.

The present invention has been created in view of the above circumstances. One of the objects is to improve season cracking resistance of a metallic fastener member comprising a copper alloy containing zinc as a base material through a different approach from the prior art. Another object of the present invention is to provide a fastener comprising such a metallic fastener member.

Means for Solving the Problem

The inventors have made intensive study to solve the above-mentioned problems, and as a result, have found that the season cracking resistance of the Cu—Zn based alloy fastener member is remarkably improved by subjecting the surface of the fastener member to a rust prevention treatment while forming a concentrated layer of Mn near the surface. With only either the formation of the concentrated layer of Mn or the rust prevention treatment, such a remarkable effect is not obtained. Therefore, it is presumed that the remarkable improvement of the season cracking resistance has been obtained by synergistic effects of both the concentrated layer of Mn and the rust prevention treatment. Conventionally, a discoloration inhibitor (a rust prevention agent) represented by benzotriazole has been sometimes used for binary Cu—Zn based alloy, but it could not sufficiently improve the season cracking resistance. Therefore, it is quite surprising to find that the season cracking resistance is remarkably improved by forming the concentrated layer of Mn in the vicinity of the surface, in addition to the rust prevention treatment.

The present invention has been completed on the basis of such findings.

In a first aspect, the present invention provides a metallic fastener member comprising, as a base material, a copper alloy containing zinc, wherein the metallic fastener member has a surface to which a rust prevention treatment has been applied and has such a property that, when analyzed by a scanning X-ray photoelectron spectroscopy apparatus, a maximum value of an atomic concentration of Mn is detected at a depth of 100 nm or less from the surface.

In one embodiment of the metallic fastener member according to the present invention, wherein when analyzing the atomic concentration of Mn in a depth direction from the surface by the scanning X-ray photoelectron spectroscopy apparatus, a maximum value of the atomic concentration of Mn is 10 at. % or more, and a depth range from the surface within which the atomic concentration of Mn is 5 at. % or more is 10 nm or more.

In another embodiment of the metallic fastener member according to the present invention, when analyzing an atomic concentration of O in the depth direction from the surface by the scanning X-ray photoelectron spectroscopy apparatus, a maximum value of the atomic concentration of O is detected at a depth of 100 nm or less from the surface, and the maximum value of the atomic concentration of O is 20 at. % or more In yet another embodiment of the metallic fastener member according to the present invention, when analyzing an atomic concentration of O in the depth direction from the surface by the scanning X-ray photoelectron spectroscopy apparatus, a depth range from the surface within which the atomic concentration of O is 5 at. % or more is 300 nm or less.

In yet another embodiment of the metallic fastener member according to the present invention, the rust preventive treatment has been applied by a rust prevention agent containing a nitrogen-containing compound.

In yet another embodiment of the metallic fastener member according to the present invention, the nitrogen-containing compound is one or more selected from the group consisting of 1,2,3-benzotriazole and derivatives thereof.

In yet another embodiment of the metallic fastener member according to the present invention, when analyzing an atomic concentration of N in a depth direction from the surface by the scanning X-ray photoelectron spectroscopy apparatus, a maximum value of an atomic concentration of N is detected at a depth of 5 nm or less from the surface.

In yet another embodiment of the metallic fastener member according to the present invention, when analyzing an atomic concentration of Zn in a depth direction from the surface by the scanning X-ray photoelectron spectroscopy apparatus, a maximum value of the atomic concentration of Zn in a range from the surface to a depth of 50 nm is lower than the atomic concentration of Zn at a depth of 300 nm from the surface.

In yet another embodiment of the metallic fastener member according to the present invention, when analyzing the atomic concentration of Zn in the depth direction from the surface by the scanning X-ray photoelectron spectroscopy apparatus, the maximum value of the atomic concentration of Zn in the range from the surface to the depth of 50 nm is 90% or less relative to the atomic concentration of Zn at the depth of 300 nm from the surface.

In yet another embodiment of the metallic fastener member according to the present invention, the metallic fastener member is an element for a slide fastener.

In yet another embodiment of the metallic fastener member according to the present invention, the base material of the metallic fastener member is a copper alloy having a composition represented by the general formula: $Cu_{bal.}Zn_aMn_b$ in which a and b are expressed in percentage by mass, and bal. denotes a balance, $34 \leq a \leq 40$, and $0 < b \leq 6$, and inevitable impurities may be contained.

In yet another embodiment of the metallic fastener member according to the present invention, a crystal structure of the base metal is a mixed phase of an α phase and a β phase.

In yet another embodiment of the metallic fastener member according to the present invention, the crystal structure of the base material is a single phase of the α phase.

In another aspect, the present invention is a fastener comprising the metallic fastener member according to the present invention.

In one embodiment of the fastener according to the present invention, the fastener is a slide fastener, the metallic fastener member is an element, and the element has an average of pull-out strength retention rate of 70% or more before and after an ammonia exposure test as measured by an ammonia test method according to JIS H3250 (2012).

Effect of the Invention

The copper alloy fastener member according to the present invention can have improved season cracking resistance by a different approach from the surface hardening treatment by means of shot blasting or the like and the ratio control of the β phase. Therefore, the copper alloy fastener member according to the present invention does not require the processing as described in Patent Document 1 as well as the strict control of the composition and the heat treatment conditions as defined in Patent Document 2 and Patent Document 3. Further, the copper alloy fastener member according to the present invention can contribute to reduction of manufacturing costs because it is possible to omit the pickling treatment which has been conventionally performed prior to the rust prevention treatment. Thus, according to the present invention, it is possible to improve the manufacturability and economy of the copper alloy fastener member having the improved season cracking resistance.

Figure 1:
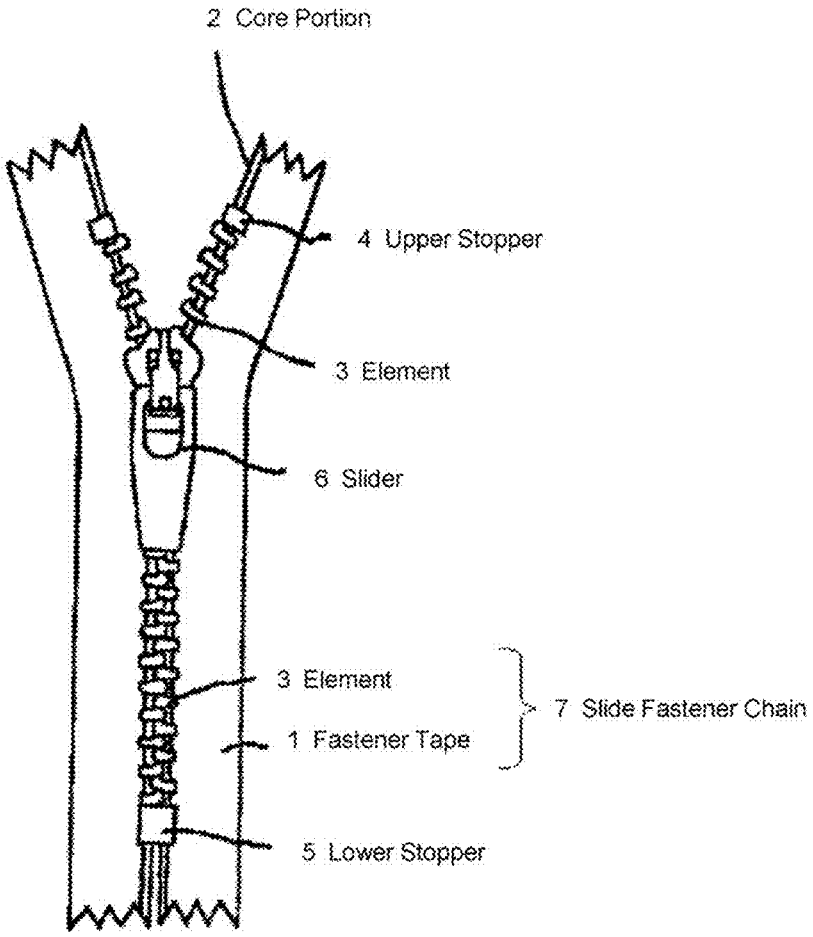
FIG. 1 is a schematic view of a slide fastener.

MODES FOR CARRYING OUT THE INVENTION (1. Profile of Mn Atomic Concentration Near Surface)

In one embodiment of the metallic fastener member according to the present invention, the maximum value of the atomic concentration of Mn is detected at a depth of 100 nm or less from the surface, typically at a depth of 50 nm or less, when analyzed by a scanning X-ray photoelectron spectroscopy apparatus. Thus, the metallic fastener member according to the present invention can be characterized in that the concentrated layer of Mn is present near the surface. When such a concentrated layer of Mn is present near the surface, the concentrated layer will play a role as a kind of barrier and the season cracking resistance will be greatly improved by synergistic effects of the layer and a rust prevention coating. While the present invention is not intended to be limited by any theory, it is presumed that development of the season cracking of the host phase based on Cu and Zn is suppressed since Mn is concentrated as an oxide on the surface layer.

The maximum value of the atomic concentration of Mn is preferably 10 at. % or more, and more preferably 15 at. % or more, and even more preferably 20 at. % or more, and still more preferably 25 at. % or more, in terms of improving the season cracking resistance. A higher maximum value of the atomic concentration of Mn may not be particularly problematic, but the maximum value would have inherent limitation because Mn near the surface would be often present in the form of an oxide. In a typical embodiment, the maximum value of the atomic concentration of Mn is 50 at. % or less, and in a more typical embodiment, the maximum value of the atomic concentration of Mn is 40 at. % or less.

The metallic fastener member preferably has a thicker concentrated layer of Mn, in terms of improving the season cracking resistance. Specifically, when the atomic concentration of Mn in the depth direction from the surface is analyzed by the scanning X-ray photoelectron spectroscopy apparatus, a depth range from the surface within which the atomic concentration of Mn is 5 at. % or more is preferably 10 nm or more, and more preferably 50 nm or more, and still more preferably 100 nm or more, and still more preferably 150 nm or more, and still more preferably 200 nm or more. The upper limit of the thickness of the concentrated layer of Mn is not particularly set, but in a typical embodiment, the depth range from the surface within which the atomic concentration of Mn is 5 at. % or more is 1000 nm or less, and in a more typical embodiment, the depth range from the surface within which the atomic concentration of Mn is 5 at. % or more is 800 nm or less, and in a still more typical embodiment, the depth range from the surface within which the atomic concentration of Mn is 5 at. % or more is 600 nm or less, and in a still more typical embodiment, the depth range from the surface within which the atomic concentration of Mn is 5 at. % or more is 500 nm or less.

A method of forming the concentrated layer of Mn near the surface includes, but not limited to, a method of oxidizing the vicinity of the surface using a base material containing Mn and a method of forming a thin film of Mn or Mn oxide on the surface of the base material. When the base material containing Mn is used, it is preferable to perform annealing in an inert or reducing atmosphere containing very low concentration (for example, about 5 to 50 ppm by mass) of oxygen. This will allow only the vicinity of the surface to be oxidized, so that Mn tends to be concentrated near the surface. On the other hand, increased oxygen concentration during the annealing will allow oxidation of the base material to deeply progress, so that Mn is hardly concentrated near the surface. A method of forming the thin film of Mn on the surface of the base material includes PVD, CVD and the like.

(2. Profile of O Atomic Concentration Near Surface)

In one embodiment of the metallic fastener member according to the present invention, the maximum value of the atomic concentration of O is detected at a depth of 50 nm or less from the surface, when analyzed by the scanning X-ray photoelectron spectroscopy apparatus. The presence of O near the surface can allow Mn to be present in the form of an oxide.

The maximum atomic concentration of O is 20 at. % or more, and more preferably 30 at. % or more, and more preferably 40 at. % or more, and even more preferably 50 at. % or more, and still more preferably 60 at. % or more, and still more preferably 70 at. % or more, since Mn is concentrated due to oxidation.

On the other hand, in order to maintain metallic luster of the fastener member and its aesthetic appearance, it is preferable that a deeper portion of the surface layer is not in a state where the atomic concentration of O is higher. More particularly, when the atomic concentration of O in the depth direction from the surface is analyzed by the scanning X-ray photoelectron spectroscopy apparatus, a depth range from the surface within which the atomic concentration of O is 5 at. % or more is preferably 300 nm or less, and more preferably 250 nm or less, and even more preferably 200 nm or less, and even more preferably 150 nm or less, and still more preferably 100 nm or less. The phrase "a depth range from the surface within which the atomic concentration of O is 5 at. % or more" means a depth range from the surface within which a state where the atomic concentration of O is 5 at. % or more is maintained, and in other words, a depth range from the surface until the atomic concentration of O becomes less than 5 at. % for the first time.

(3. Profile of Zn Atomic Concentration Near Surface)

In one preferred embodiment of the metallic fastener member according to the present invention, when analyzed by the scanning X-ray photoelectron spectroscopy apparatus, the maximum value of the atomic concentration of Zn in a range from the surface to the depth of 50 nm is lower than the atomic concentration of Zn at the depth of 300 nm from the surface. To put it shortly, it is preferable that Zn is not concentrated near the surface. This is because the effect of significantly improving the season crack resistance does not appear so much even if Zn is concentrated near the surface. The maximum value of the atomic concentration of Zn in the range from the surface to the depth of 50 nm is preferably 90% or less, and more preferably 80% or less, and more preferably 70% or less, of the atomic concentration of Zn at the depth of 300 nm from the surface. When annealing is performed under a highly oxidizing atmosphere such as an air atmosphere during the producing steps of the metallic fastener member, Zn is preferentially oxidized to be concentrated near the surface. Therefore, it is necessary to pay attention to the atmosphere of annealing.

The maximum value of the atomic concentration of Zn in the range from the surface to the depth of 50 nm is preferably 25 at. % or less, and more preferably 20 at. % or less. Although the lower limit of the maximum value of the atomic concentration of Zn in the range from the surface to the depth of 50 nm is not particularly set, since the maximum value of the atomic concentration of Zn in the range from the surface to the depth of 50 nm is affected by Zn in the base material, the maximum value may be generally 40% or more, and typically 50% or more, and more typically 60% or more, of the atomic concentration of Zn at the depth of 300 nm from the surface.

(4. Composition of Base Material)

The metallic fastener member according to the present invention comprises, as a base material, a copper alloy containing zinc. Zn has an effect of improving mechanical properties and work hardening properties of the alloy by solid solution strengthening, a deacidification effect during melt casting and an effect of reducing the price of the fastener member. The increased content of Zn can reduce the costs and provide high strength. It also provides an advantage that the oxidation resistance and castability of the molten metal are also improved. However, if Zn is contained in the copper alloy, the season cracking resistance deteriorates. In particular, when the Zn concentration is 10% by mass or more, the season cracking resistance drastically deteriorates.

Therefore, from the viewpoint of improving the season cracking resistance while taking advantage of the above properties that will be obtained by zinc, the metallic fastener member according to the present invention preferably comprises a copper alloy containing Zn of 10% by mass or more as a base material, and more preferably a copper alloy containing Zn of 15% by mass or more as a base material, and more preferably a copper alloy containing Zn of 20% by mass or more as a base material, and further preferably a copper alloy containing Zn of 25% by mass or more as a base material, and even more preferably a copper alloy containing Zn of 30% by mass or more as a base material, and still more preferably a copper alloy containing Zn of 35% by mass or more as a base material. However, if the content of Zn is excessive, the cold workability is impaired. Therefore, the metallic fastener member according to the present invention is preferably made of a copper alloy containing 50% by mass or less of Zn as a base material, and more preferably a copper alloy containing 45% by mass or less of Zn as a base material, and still more preferably a copper alloy containing 40% by mass or less of Zn as a base material.

Further, in the case of concentrating Mn near the surface using Mn contained in the base material, the Mn concentration in the composition of the copper-zinc alloy as the base material is preferably 0.1% by mass or more, and more preferably 0.5% by mass or more, and still more preferably 1.0% by mass or more. However, if the Mn concentration in the composition of the copper-zinc alloy as the base material is too high, the Cu concentration and the Zn concentration are decreased so that the original properties of the copper-zinc alloy are impaired. Therefore, the Mn concentration in the copper-zinc alloy as the base material is preferably less than the Zn concentration, and more preferably not more than 1/5 of the Zn concentration, and even more preferably not more than 1/10 of the Zn concentration. More particularly, the Mn concentration in the copper-zinc alloy as the base material is preferably 6% by mass or less, and more preferably 4% by mass or less, and still more preferably 2% by mass or less.

In one preferred embodiment of the metallic fastener member according to the present invention, a copper alloy can be used as a base material, which has a composition represented by the general formula: $Cu_{bal.}Zn_aMn_b$ wherein a and b are expressed in percentage by mass, and bal. denotes the balance, $34 \leq a \leq 40$ and $0 < b \leq 6$, and inevitable impurities may be contained. The symbol a is typically $36 \leq a \leq 39$, and more typically $37 \leq a \leq 39$. The symbol b is typically $0.1 \leq b \leq 4$, and more typically $0.5 \leq b \leq 2$. The inevitable impurities refer to generally acceptable impurities because although they are inherently unnecessary substances in metal products, which may be present in raw materials or inevitably mixed in producing steps, they are present in a miner amount and have no effect on the metal products. In the present invention, the content of each impurity element that is acceptable as inevitable impurities is generally 0.1% by mass or less, and preferably 0.05% by mass or less.

(5. Crystal Structure)

The metallic fastener member according to the present invention can exhibit the improved season cracking resistance regardless of the crystal structure of the base material, and so the ratio of the β phase is not particularly limited. Therefore, the base material may be a mixed phase of the α phase and the β phase, or may be a single phase of the α phase. However, the mixed phase of the α phase and the β phase tends to have better season cracking resistance, and thus the ratio of the β phase is preferably 0.1% or more, and more preferably 0.5% or more, and still more preferably 1% or more, and even more preferably 5% or more. However, if the ratio of the β phase is too high, the cold workability cannot be ensured, and so the ratio of the β phase is preferably 22% or less, and more preferably 20.5% or less, and more preferably 15% or less, and still more preferably 10% or less.

The ratio of the β phase in the crystal structure is determined by polishing the metallic fastener member with a SiC waterproof abrasive paper and mirror-finishing it with diamond to expose a cross section perpendicular to the rolling surface, and analyzing the cross section by an X ray diffraction method (θ−2θ method) and calculating an integrated value of peak intensities of the α phase and the β phase, as follows: the ratio of the β phase ratio (%)=(an integrated value of β phase peak intensity)/(an integrated value of α phase peak intensity+an integrated value of β phase peak intensity)×100.

The crystal structure of the base metal is generally defined by a zinc equivalent. The zinc equivalent can be expressed by the following equation:

zinc equivalent=(Zn concentration+0.5×Mn concentration)/(Cu concentration+Zn concentration+0.5×Mn concentration)×100, in which each of the Zn concentration, Mn concentration and Cu concentration is on a mass basis.

The mixed phase of the α phase and the β phase tends to be readily formed when the zinc equivalent is 38.7 or more. In order to increase the ratio of the mixed phase of the α phase and the β phase, the zinc equivalent may be 38.8 or more, and further 39.0 or more, for example, in the range of 38.7 to 41.

(6. Method for Producing Metallic Fastener Member)

A suitable method for producing the metallic fastener member according to the present invention will be described. Although the shape of the metallic fastener member is not particularly limited, elements for a slide fastener, which is a typical use thereof, will be described as an example. First, alloy components making up the base material are mixed and melted, and a wire is then produced by continuous casting. After irregularities of the surface of the resulting wire are removed by a method such as stripping, the wire is subjected to wire drawing processing. The wire is then annealed to restore workability. When using the base material containing Mn, it is convenient from viewpoint of producibility that Mn is concentrated near the surface by carrying out the annealing in an inert or reducing atmosphere containing extremely low oxygen concentration (for example, about 5 to 50 ppm by mass). A substantially Y-shaped continuous deformed wire is then produced while applying work strain by cold rolling. During this process, work hardening is progressed depending on the alloy composition, and the material strength is increased. Subsequently, the elements are subjected to various cold working such as cutting, pressing, bending and caulking to attach the elements to the fastener tape. The fastener elements can be subjected to a surface treatment such as a rust prevention treatment before and/or after the attachment to the fastener tape. In addition, when a thin film of Mn or Mn oxide is formed on the surface of the base material by PVD or CVD, the forming of such a thin film may be performed at any of the wire, deformed wire and chain stages.

The metallic fastener member according to the present invention may be optionally subjected to various surface treatments. For example, the metallic fastener member may be subjected to a rust prevention treatment, a chemical conversion treatment, a clear coating treatment, a plating treatment and the like. Among these, the rust prevention treatment is essential for the improvement of the season cracking resistance, which is the object of the present invention. Conventionally, the rust prevention treatment has been applied to prevent production of oxides on the metallic fastener member surface, and then to improve the adhesion of the coating film in the case of performing the clear coating or plating treatment. However, it has not provided satisfactory season cracking resistance. In the present invention, since the concentrated layer of Mn is formed near the surface, the season cracking resistance can be remarkably improved in combination with the rust prevention treatment.

The rust prevention treatment involves steps of rust prevention, water washing and drying. The rust prevention step can be carried out by dipping or spraying using a known benzotriazole based compound, a phosphoric ester based compound, or other rust prevention liquids. A surfactant(s) may be added in order to improve wettability of the metallic fastener member. The water washing step after the rust prevention step may be omitted if the rust prevention agent does not adversely affect the fastener tape. The drying step may be preferably carried out using hot air or other heat source at a temperature of 150° C. or below that does not affect color fastness of the fastener tape. Conventionally, prior to the rust prevention treatment, a pickling step has been usually carried out for removing the oxide film on the surface to improve the adhesion of the rust prevention coating. However, there is a risk that the pickling may remove the concentrated layer of Mn. Therefore, it is preferable that the pickling step prior to the rust prevention treatment is not carried out.

In a typical embodiment of the metallic fastener member according to the present invention, the rust prevention step is carried out using a rust prevention agent containing a nitrogen-containing compound. Examples of the nitrogen-containing compound include 1,2,3-benzotriazole and derivatives thereof. 1,2,3-benzotriazole is one of heterocyclic compounds containing three nitrogen atoms in their molecules, represented by the following formula 1:

formula 1

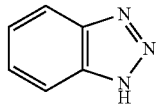

The derivative of 1,2,3-benzotriazole is a compound having a benzotriazole group, represented by the following formula 2. The hydrogen atoms on the benzene ring may optionally be substituted with a substituent such as an alkyl group including methyl and ethyl, or a carboxyl group.

formula 2

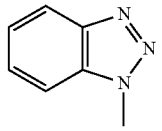

1,2,3-benzotriazole and derivatives thereof are conventionally used as rust prevention agents. The derivatives of 1,2,3-benzotriazole commonly used as the rust prevention agents include 1-[N,N-bis(2-ethylhexyl)aminomethyl]benzotriazole, carboxybenzotriazole, 1-[N,N-bis(2-ethylhexyl)aminomethyl]methylbenzotriazole, 2,2'-[[(methyl-1H-benzotriazole-1-yl)methyl]imino]bis-ethanol and the like. These nitrogen-containing compounds may be used alone or in combination of two or more.

When the rust prevention treatment is thus carried out using the nitrogen-containing compound, analysis of a surface state of the metallic fastener member according to the present invention after the rust prevention treatment based on measurement of the atomic concentration of N in the depth direction from the surface by the scanning X-ray photoelectron spectroscopy apparatus can show detection of a maximum value of the atomic concentration of N very near from the surface. Typically, the maximum value of the atomic concentration of N can be detected at a depth of 5 nm or less from the surface, and more typically, the maximum value of the atomic concentration of N can be detected at a depth of 1 nm of less from the surface. For enhancing the effect of improving the season cracking resistance, the maximum value of the atomic concentration of N is preferably 1 at. % or more, and more preferably 3 at. %, and even more preferably 5 at. % or more, and still more preferably 7 at. %. The upper limit of the atomic concentration of N is not particularly limited, but it may be generally 50 at. % or less, and more preferably 25 at. % or less, and even more preferably 15 at. % or less.

After the rust prevention step, a clear coating treatment (a coating step+a drying step) or a plating treatment may be carried out to improve corrosion resistance, weather resistance and the like. The clear coating treatment allows the corrosion resistance of the metallic fastener member to be increased. The clear coating treatment can be carried out, for example by applying a clear coating to the surface of the metallic fastener member with a roll coater or other method and then drying the coating. The plating treatment may be carried out by various methods, such as an electroplating method for the purpose of improvement of the corrosion resistance or decoration (an electroless plating may be preferably carried out prior to the electroplating), as well as dry plating such as vacuum deposition, sputtering and ion plating methods.

Further, as a final step, waxing may be carried out to reduce sliding friction. This step may be omitted if the sliding friction is sufficiently low.

(7. Slide Fastener)

Examples of the slider fastener comprising the metallic fastener members (elements, upper stoppers and a lower stopper) according to the present invention will be described with reference to Figures. FIG. 1 is a schematic view of the slide fastener. As shown in FIG. 1, the slide fastener comprises a pair of fastener tapes 1 each having a core portion 2 formed on one side edge; elements 3 fixed to the core portion 2 of each fastener tape 1 by means of caulking and arranged at predetermined intervals on the core portion 2; an upper stopper 4 and a lower stopper 5 fixed to the core portion 2 of the fastener tape 1 by means of caulking at the upper end and the lower end of the row of elements 3, respectively; and a slider 6 arranged between a pair of the opposing elements 3 and slidable in the up and down direction so as to engage and disengage the pair of the elements 3. An article in which the elements 3 have been attached along one side edge of one fastener tape 1 is referred to as a slide fastener stringer, and an article in which the elements 3 attached to the core portion 2 of a pair of the fastener tapes 1 have been engaged with each other is referred to as a slide fastener chain 7.

Further, the slider 6 shown in FIG. 1 is obtained by subjecting a long body (not shown) made of a plate-like body having a rectangular cross section to press working in multiple stages and cutting the long body at predetermined intervals to prepare a slider body, and further attaching a spring and a pull tab to the slider body as necessary. Furthermore, the pull tab is obtained by stamping out the plate-like body having the rectangular cross section into a predetermined shape, and the pull tab is fixed to the slider body by means of caulking. It is noted that the lower stopper 5 may be an openable, closable and fittingly insertable tool consisting of an insert pin, a box pin and a box body, so that the pair of slide fastener chains can be separated by separating operation of the slider.

Figure 2:
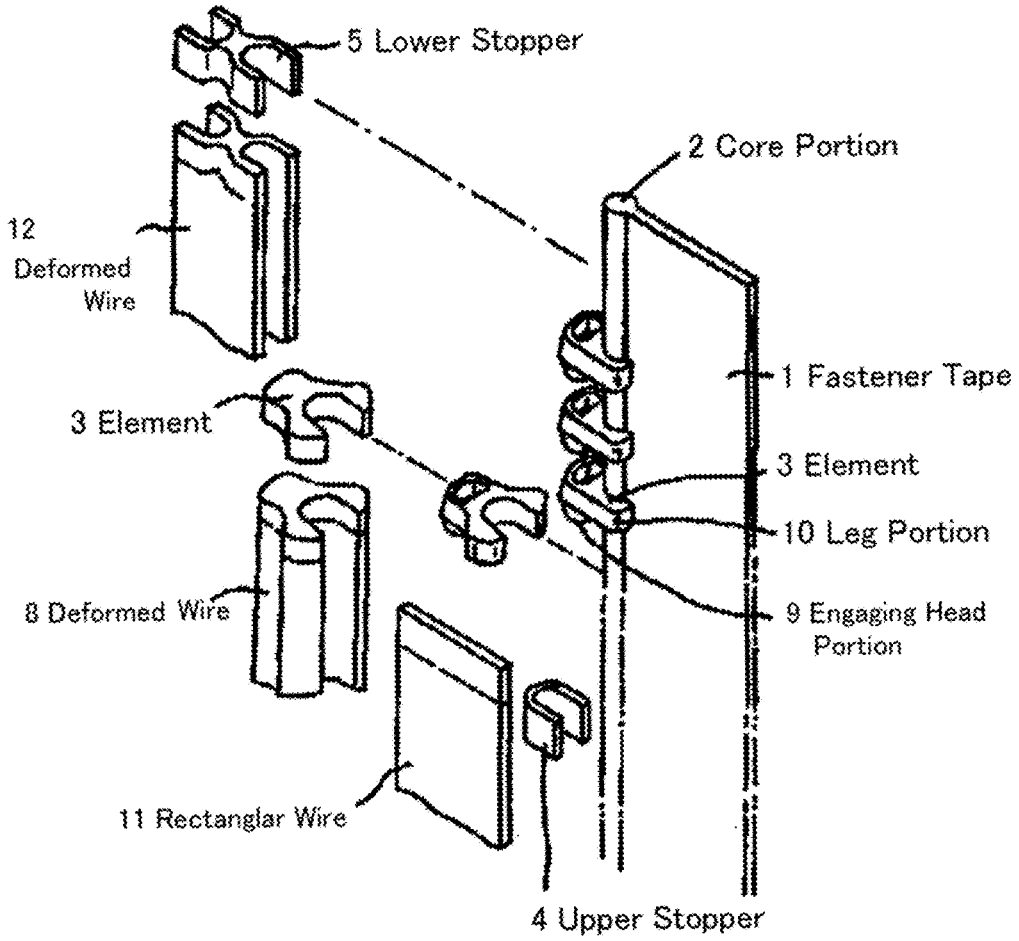
FIG. 2 is a view for explaining how to attach a lower stopper, an upper stopper and elements to a fastener tape.
Figure 3:
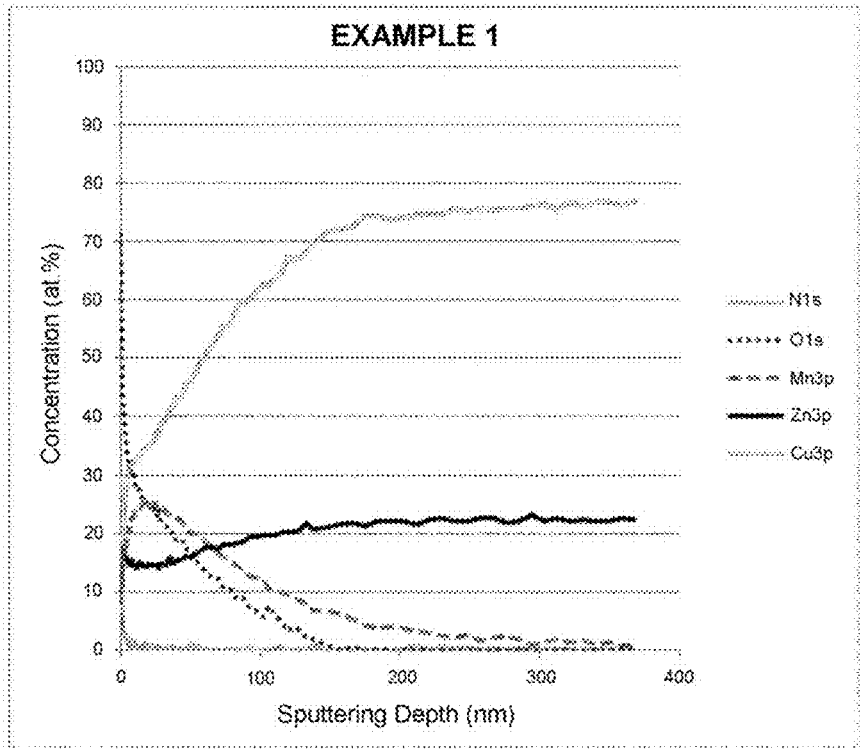
FIG. 3 is a depth profile of an atomic concentration of each of N, O, Mn, Zn and Cu on an element surface of Example 1 as analyzed by XPS.
Figure 4:
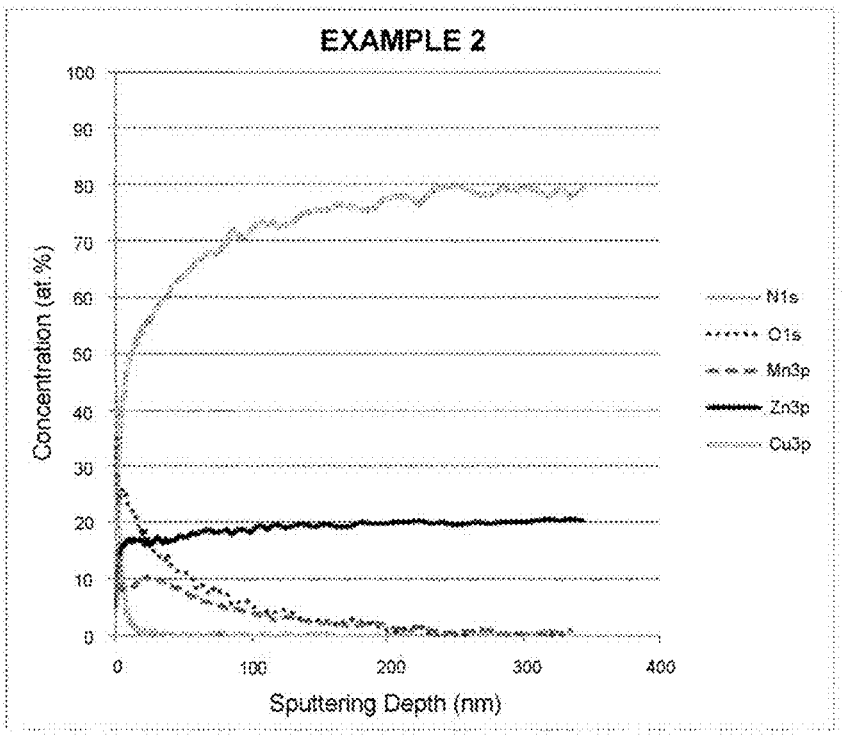
FIG. 4 is a depth profile of an atomic concentration of each of N, O, Mn, Zn and Cu on an element surface of Example 2 as analyzed by XPS.
Figure 5:
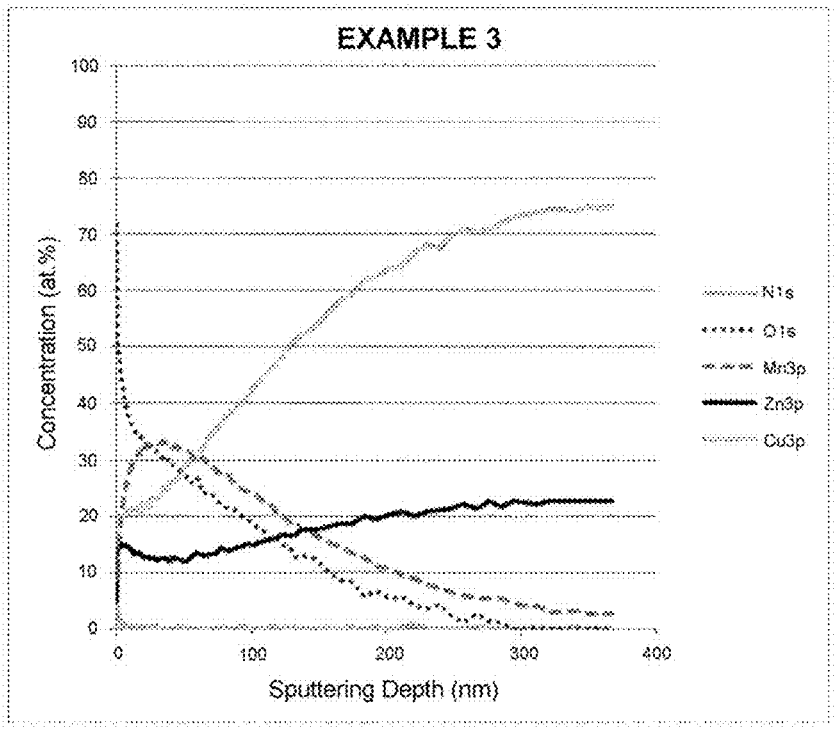
FIG. 5 is a depth profile of an atomic concentration of each of N, O, Mn, Zn and Cu on an element surface of Example 3 as analyzed by XPS.
Figure 6:
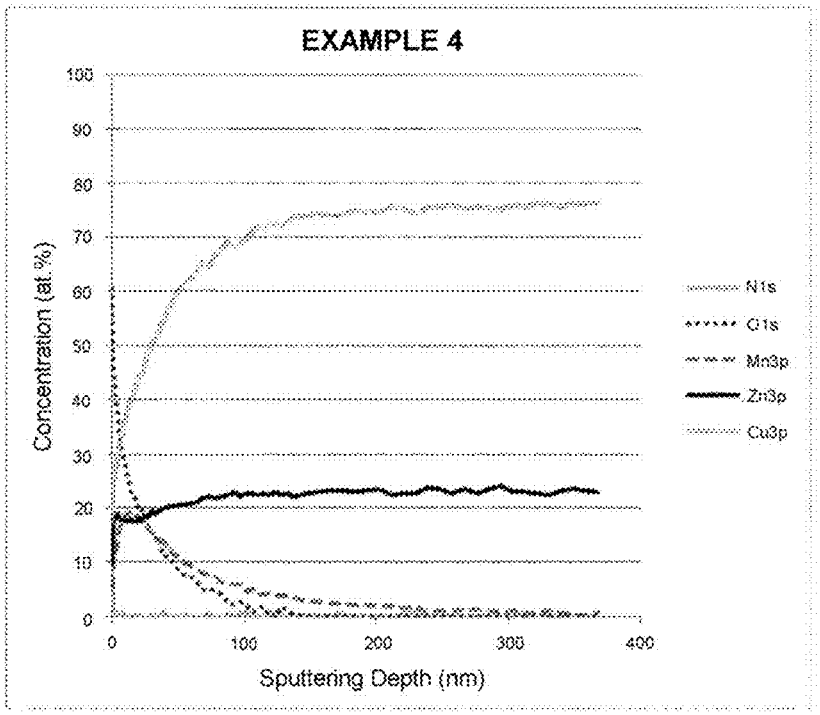
FIG. 6 is a depth profile of an atomic concentration of each of N, O, Mn, Zn and Cu on an element surface of Example 4 as analyzed by XPS.
Figure 7:
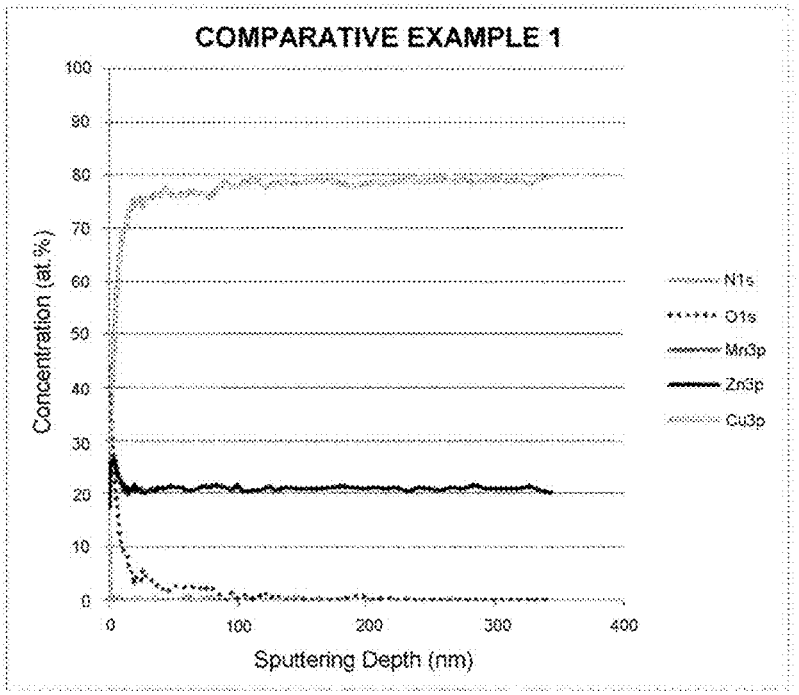
FIG. 7 is a depth profile of an atomic concentration of each of N, O, Mn, Zn and Cu on an element surface of Comparative Example 1 as analyzed by XPS.
Figure 8:
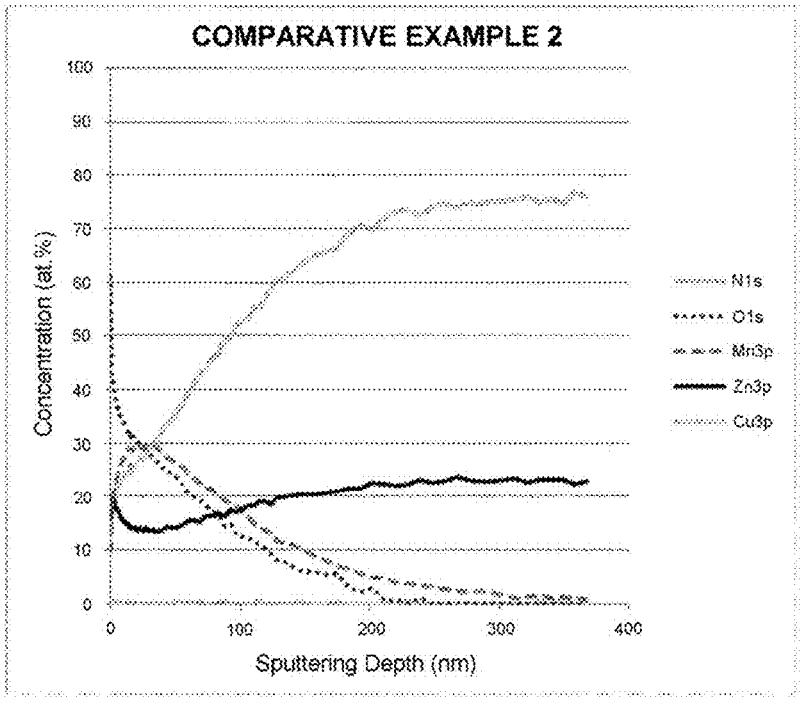
FIG. 8 is a depth profile of an atomic concentration of each of N, O, Mn, Zn and Cu on an element surface of Comparative Example 2 as analyzed by XPS.
Figure 9:
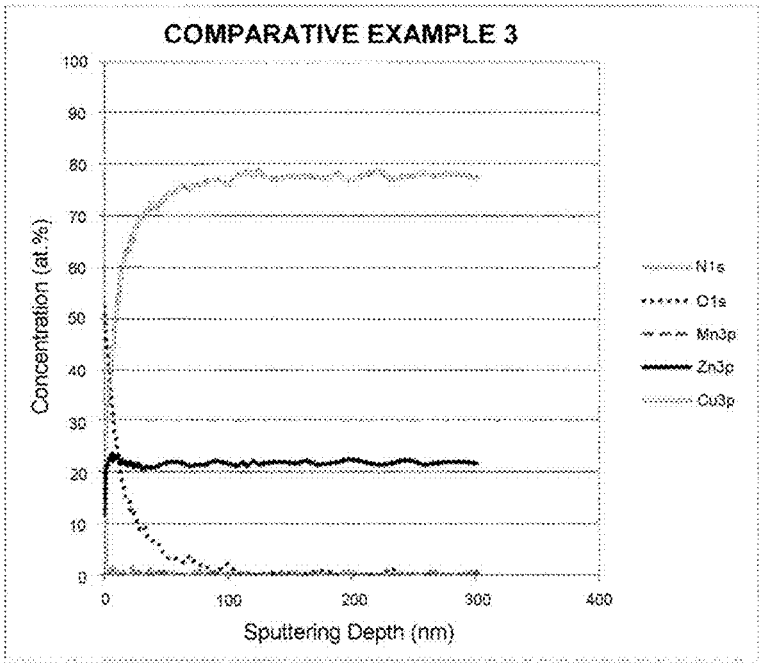
FIG. 9 is a depth profile of an atomic concentration of each of N, O, Mn, Zn and Cu on an element surface of Comparative Example 3 as analyzed by XPS.

FIG. 2 is a view showing a method for assembling the elements 3, the upper stoppers 4 and the lower stopper 5 for the slide fastener as shown in FIG. 1 and how to attach these members to the core portion 2 of the fastener tape 1. As shown in FIG. 2, the elements 3 are formed by cutting a deformed wire 8 having a substantially Y-shaped cross section into pieces each having a predetermined dimension, and pressing each piece so as to form an engaging head portion 9, and the elements are then attached to the core portion 2 by caulking both the leg portion 10 onto the core portion 2 of the fastener tape 1.

The upper stopper 4 is formed by cutting a rectangular wire 11 (flat wire) having a rectangular cross section into pieces each having a predetermined dimension, and bending each piece to form a substantially U-shaped cross section, and is then attached to the core portion 2 by caulking the piece onto the core portion 2 of the fastener tape 1. The lower stopper 5 is formed by cutting a deformed wire 12 having a substantially X-shaped cross section 12 into pieces each having a predetermined dimension, and is then attached to the core portion 2 by caulking the piece onto the core portion 2 of the fastener tape 1.

It is note that FIG. 2 seems to show the elements 3, the upper stoppers 4 and the lower stopper 5 are simultaneously attached to the fastener tape 1, however, actually, the elements 3 are first attached continuously to the fastener tape 1 to form a fastener chain, the elements 3 placed in attaching regions for the stoppers in the fastener chain are then removed, and the predetermined upper and lower stoppers 4, 5 are then attached in these regions near the elements 3. Since the production and attachment are performed in such a way, the elements and the stoppers which are components of the slide fastener members should have good cold workability. In this regard, the metallic fastener members according to the present invention have good cold workability, and for example, they can be formed with a rolling reduction of 70% or more. Therefore, they are suitable as materials for the elements and the upper and lower stoppers.

The slide fastener according to the present invention can be attached to various articles, and particularly functions as an opening/closing tool. The articles to which the slide fastener is attached include, but not limited to, daily necessities such as clothes, bags, shoes and miscellaneous goods, as well as industrial goods such as water storage tanks, fishing nets and space suites.

In an embodiment of the slide fastener provided with the elements having the improved season cracking resistance according to the present invention, an average of retention of pull-out strength of the element before and after an ammonia exposure test by an ammonia test according to JIS H3250 (2012) can be 70% or more. The average of retention of pull-out strength of the element may be preferably 75% or more, and more preferably 80% or more, and even more preferably 85% or more, and still more preferably 90% or more, for example 70 to 95%.

While the embodiments where the metallic fastener member according to the present invention is applied to the elements for the slide fastener have been mainly described, the metallic fastener member according to the present invention is not limited to the use for the slide fastener. The metallic fastener member can also be applied as a member(s) for snap fasteners or other metallic fasteners.

EXAMPLES

Hereinafter, Examples of the present invention are illustrated, but they are provided for better understanding of the present invention and its advantages, and are not intended to limit the present invention.

<Preparation of Fastener Chain>

Using Cu (purity of 99.99% by mass or more), Zn (purity of 99.9% by mass or more), and Mn (purity of 99.9% by mass or more) as raw materials, these raw materials were blended so as to have each alloy composition according to the test number as shown in Table 1, and melted in a continuous casting machine, and a continuous wire was then produced by continuous casting process. The resulting continuous wire was subjected to a wire drawing treatment. Thereafter, the continuous wire was subjected to annealing under a reduced atmosphere containing about 10 ppm by mass of oxygen at 500° C. for one hour to restore the cold workability, and a continuous deformed wire having a substantially Y-shaped cross section was then produced by cold rolling. Various cold working processes such as cutting, pressing, bending and caulking were then performed on the wire to form elements each having the dimension of "5R" as defined in the catalog "FASTENING SENKA (issued by YKK Co., Ltd. on February 2009)". The elements were then attached to a polyester fastener tape to form a fastener stringer, and the opposing elements of a pair of fastener stringers were further engaged with each other to form a fastener chain.

<Rust Prevention Treatment>

The fastener chains having the test numbers, labelled as Rust Prevention Treatment "Yes" in Table 1, were subjected to the rust prevention treatment by immersing the fastener chains in an aqueous rust prevention agent solution containing 1,2,3-benzotriazole (BTA), and then washing them with water and drying them. In this case, no pickling was carried out before the rust prevention treatment for Examples 1 to 4 and Comparative Example 1. The pickling was carried out for Comparative Example 3. In addition, Comparative Example 2 was directly subjected to various evaluations without conducting the pickling and the rust prevention treatment.

<Surface Layer Analysis>

Atomic concentration profiles of Mn atom, O atom, N atom and Zn atom in the depth direction on the surface of any one of the elements of each fastener chain were measured by the scanning X-ray photoelectron spectroscopy (XPS) apparatus. The atomic concentration was calculated as a total 100% of Cu, N, O, Mn and Zn. Measurement conditions are as follows:

X-ray: monochromatic Al ray source (1486.6 eV), 25 W;
Diameter of X-ray: 100 μm;
Take Off Angle: 45°;
Neutralization: None;
Ion Species: $Ar^+$;
Sputtering Rate: 4.3 nm/min ($SiO_2$ Sputtering Rate Conversion);
Background: Straight Line Method.

The measured results are shown in Table 1 and FIGS. 3-9. The definition of detection depth is in accordance with ISO/TR 15969 (ISO Technical Report) and TS K0012 (Japanese Standards Association, Standard Specifications). Relative sensitivity factors by Wagner were applied to 1 s peak for the light metal and 3p peak for the metal elements to calculate the atomic concentration. Mn3p: 45.5-54 eV; O1s: 527-539 eV; N1s: 397-404 eV; Zn3p: 85-96 eV; Cu3p: 69-81 eV.

<Evaluation of Ratio of β Phase>

For any one of the elements of each fastener chain, a cross-sectional structure perpendicular to the rolling surface was observed by cross-sectional photographs. The cross section perpendicular to the rolling surface was exposed by polishing the element using SiC waterproof abrasive papers (from #180 to #2000), and the cross section was further subjected to mirror finishing using diamond pastes having mean particle sizes of 3 m and 1 m in this order to obtain a specimen, and the specimen was then subjected to measurement by X-ray diffraction. Using GADDS-Discover 8 available from Bruker AXS Inc. as a measuring apparatus, each peak intensity integrated value of the α and β phases was measured for a measuring time of 90 s for a lower angle side and 120 s for a higher angle side. The ratio of the β phase was calculated according to the equation: the ratio of the β phase (%)=(an integrated value of β phase peak intensity)/(an integrated value of α phase peak intensity+an integrated value of β phase peak intensity)×100.

<Evaluation of Season Cracking Resistance>

The fastener chain was exposed to ammonia according to an ammonia test method defined in JIS H3250 (2012). The test was carried out at normal temperature for 50 minutes by placing the fastener chain in a desiccator containing aqueous ammonia having a concentration of 15% at a position of 50 mm apart from the liquid surface. Pull-out strength of the element was then measured for the fastener chain. Using an Instron type tensile tester, the pull-out test was carried out by grasping the engaging head of one element with a jig, pulling it at a pulling rate of 300 mm/min. until the element was pulled out from the fastener tape fixed to a clamp. The maximum strength was measured during this operation. The pulling direction of the element was a direction perpendicular to the longitudinal direction of the fastener tape and parallel to the surface of the fastener tape. The measured results were reported as average values after conducting the measurement six times.

TABLE 1

| | Alloy Composition (% by mass) | | | Rust Prevention | Pickling Before Rust Prevention | β Ratio | Pull-out Strength Retention After Ammonia Exposure |
|---|---|---|---|---|---|---|---|
| | Cu | Zn | Mn | Treatment | Treatment | (%) | (%) |
| Example 1 | 61.3 | 38.7 | 1.0 | Yes | No | 6.4 | 94 |
| Example 2 | 61.8 | 38.0 | 0.2 | Yes | No | 0.05 | 79 |
| Example 3 | 61.1 | 38.1 | 0.8 | Yes | No | 0 | 83 |
| Example 4 | 61.0 | 38.3 | 0.7 | Yes | No | 0.9 | 85 |
| Comparative Example 1 | 65.0 | 35.0 | 0.0 | Yes | No | 0 | 67 |
| Comparative Example 2 | 61.1 | 38.1 | 0.8 | No | — | 0 | 69 |
| Comparative Example 3 | 61.8 | 38.0 | 0.2 | Yes | Yes | 0.05 | 63 |

| | N Atomic Concentration Analysis of Surface Layer | |
|---|---|---|
| | N Maximum Value Detection Depth (nm) | N Maximum Value (at. %) |
| Example 1 | 0 | 9 |
| Example 2 | 0 | 44 |

TABLE 1-continued

| | | |
|---|---|---|
| Example 3 | 0 | 10 |
| Example 4 | 0 | 6 |
| Comparative Example 1 | 0 | 13 |
| Comparative Example 2 | No Significant Peak | less than 1% |
| Comparative Example 3 | 0 | 14 |

| | Mn Atomic Concentration Analysis of Surface Layer | | |
|---|---|---|---|
| | Mn Maximum Value Detection Depth (nm) | Mn Maximum Value (at. %) | Depth Range from Surface within Which Mn Atomic Concentration is 5 at. % or more (nm) |
| Example 1 | 17 | 26 | about 170 |
| Example 2 | 1 | 13 | about 80 |
| Example 3 | 35 | 34 | about 290 |
| Example 4 | 14 | 19 | about 100 |
| Comparative Example 1 | Not detected | Not detected | — |
| Comparative Example 2 | 24 | 30 | about 200 |
| Comparative Example 3 | No Significant Peak | less than 1% | — |

| | O Atomic Concentration Analysis of Surface Layer | | |
|---|---|---|---|
| | O Maximum Value Detection Depth (nm) | O Maximum Value (at. %) | Depth Range from Surface within Which O Atomic Concentration is 5 at. % or more (nm) |
| Example 1 | 0 | 71 | about 112 |
| Example 2 | 0 | 35 | about 100 |
| Example 3 | 0 | 72 | about 220 |
| Example 4 | 0 | 61 | about 68 |
| Comparative Example 1 | 0 | 44 | about 18 |
| Comparative Example 2 | 1 | 44 | about 180 |
| Comparative Example 3 | 0 | 52 | about 65 |

| | Zn Atomic Concentration Analysis of Surface Layer | | |
|---|---|---|---|
| | Zn Maximum Value (A) in Range from Surface to Depth of 50 nm (at. %) | Zn Concentration (B) at Depth of 300 nm (at. %) | A/B |
| Example 1 | 18 | 22 | 0.80 |
| Example 2 | 17 | 20 | 0.87 |
| Example 3 | 15 | 22 | 0.67 |
| Example 4 | 20 | 23 | 0.88 |
| Comparative Example 1 | 27 | 21 | 1.30 |
| Comparative Example 2 | 20 | 23 | 0.85 |
| Comparative Example 3 | 23 | 22 | 1.08 |

DISCUSSION

The results of Comparative Example 1 (which does not contain Mn in the base material) and Comparative Example 3 (with pickling before the rust prevention treatment) demonstrate that sufficient season cracking resistance cannot be obtained even if the element is subjected to the rust prevention treatment unless the concentrated layer of Mn is formed near the surface of the element. The results of Comparative Example 2 (no rust prevention treatment) demonstrates that sufficient season cracking resistance cannot be obtained even if the concentrated layer of Mn is formed unless the element has not been subjected to the rust prevention treatment. In contrast, Examples 1 to 4 which carried out the rust prevention treatment and formed the concentrated layer of Mn near the surface of the element showed that degradation of the average pull-out strength of the element before and after the ammonia exposure test is significantly suppressed, resulting in the improved season cracking resistance. Further, it is understood that although the increased ratio of the β phase tends to improve the season cracking resistance, the excellent season cracking resistance can be obtained by thickening the Mn oxide layer, even if the ratio of the β phase is lower, and further it is 0%.

Incidentally, it was observed that when the annealing during the production of the fastener chain was carried out at 450° C. for 1 hour under air atmosphere, Zn was preferentially oxidized and Zn was concentrated near the surface. In this case, for the depth profile of the atomic concentration of Mn, no significant peak was observed due to the broad concentration distribution of Mn, and no maximum value of the atomic concentration of Mn was present at a depth of 100 nm or less from the surface.

DESCRIPTION OF REFERENCE NUMERALS

1 fastener tape
2 core portion
3 element
4 upper stopper
5 lower stopper
6 slider
7 slide fastener chain
8 deformed wire having Y-shaped cross section
9 engaging head
10 leg portion
11 rectangular wire
12 deformed wire having X-shaped cross section

What is claimed is:

1. A metallic fastener member comprising, as a base material, a copper alloy containing zinc, wherein the metallic fastener member has a surface to which a rust prevention treatment has been applied and has such a property that, when analyzed by a scanning X-ray photoelectron spectroscopy apparatus, a maximum value of an atomic concentration of Mn is detected at a depth of 100 nm or less from the surface.

2. The metallic fastener member according to claim 1, wherein when analyzing the atomic concentration of Mn in a depth direction from the surface by the scanning X-ray photoelectron spectroscopy apparatus, a maximum value of the atomic concentration of Mn is 10 at. % or more, and a depth range from the surface within which the atomic concentration of Mn is 5 at. % or more is 10 nm or more.

3. The metallic fastener member according to claim 1, wherein when analyzing an atomic concentration of O in a depth direction from the surface by the scanning X-ray photoelectron spectroscopy apparatus, a maximum value of the atomic concentration of O is detected at a depth of 100 nm or less from the surface, and the maximum value of the atomic concentration of O is 20 at. % or more.

4. The metallic fastener member according to claim 1, wherein when analyzing an atomic concentration of O in a depth direction from the surface by the scanning X-ray photoelectron spectroscopy apparatus, a depth range from the surface within which the atomic concentration of O is 5 at. % or more is 300 nm or less.

5. The metallic fastener member according to claim 1, wherein the rust preventive treatment has been applied by a rust prevention agent containing a nitrogen-containing compound.

6. The metallic fastener member according to claim 5, wherein the nitrogen-containing compound is one or more selected from the group consisting of 1,2,3-benzotriazole and derivatives thereof.

7. The metallic fastener member according to claim 5, wherein when analyzing an atomic concentration of N in a depth direction from the surface by the scanning X-ray photoelectron spectroscopy apparatus, a maximum value of an atomic concentration of N is detected at a depth of 5 nm or less from the surface.

8. The metallic fastener member according to claim 1, wherein when analyzing an atomic concentration of Zn in a depth direction from the surface by the scanning X-ray photoelectron spectroscopy apparatus, a maximum value of the atomic concentration of Zn in a range from the surface to a depth of 50 nm is lower than the atomic concentration of Zn at a depth of 300 nm from the surface.

9. The metallic fastener member according to claim 8, wherein when analyzing the atomic concentration of Zn in the depth direction from the surface by the scanning X-ray photoelectron spectroscopy apparatus, the maximum value of the atomic concentration of Zn in the range from the surface to the depth of 50 nm is 90% or less relative to the atomic concentration of Zn at the depth of 300 nm from the surface.

10. The metallic fastener member according to claim 1, wherein the metallic fastener member is an element for a slide fastener.

11. The metallic fastener member according to claim 1, wherein the base material of the metallic fastener member is a copper alloy having a composition represented by a general formula: $Cu_{bal}Zn_aMn_b$ in which a and b are expressed in percentage by mass, and bal. denotes a balance, $34 \leq a \leq 40$, and $0 < b \leq 6$, and inevitable impurities may be contained.

12. The metallic fastener member according to claim 1, wherein a crystal structure of the base material is a mixed phase of an α phase and a β phase.

13. The metallic fastener member according to claim 1, wherein the crystal structure of the base material is a single phase of an α phase.

14. A fastener comprising the metallic fastener member according to claim 1.

15. The fastener according to claim 14, wherein the fastener is a slide fastener, wherein the metallic fastener member is an element, and wherein the element has an average of pull-out strength retention rate of 70% or more before and after an ammonia exposure test as measured by an ammonia test method according to JIS H3250 (2012).

* * * * *